United States Patent [19]

Barth et al.

[11] Patent Number: 4,918,868

[45] Date of Patent: Apr. 24, 1990

[54] ECCENTRIC GRINDER

[75] Inventors: Walter Barth, Leinfelden; Karl-Heinz Braunbach, Hornbach; Manfred Stäbler, Leinfelden-Echterdingen, all of Fed. Rep. of Germany

[73] Assignee: Robert Bosch GmbH, Stuttgart, Fed. Rep. of Germany

[21] Appl. No.: 368,363

[22] PCT Filed: Nov. 21, 1987

[86] PCT No.: PCT/DE87/00540

§ 371 Date: Jun. 6, 1989

§ 102(e) Date: Jun. 6, 1989

[87] PCT Pub. No.: WO88/04218

PCT Pub. Date: Jun. 16, 1988

[30] Foreign Application Priority Data

Dec. 13, 1986 [DE] Fed. Rep. of Germany ..... 3642741

[51] Int. Cl.[5] ..... B24B 7/00

[52] U.S. Cl. ..... 51/120; 51/170 MT

[58] Field of Search ..... 51/120, 170 MT, 119, 51/90, 170 TL; 74/804, 805

[56] References Cited

U.S. PATENT DOCUMENTS

| | | | |
|---|---|---|---|
| 2,794,303 | 6/1957 | Wickes . | |
| 3,482,362 | 12/1969 | Bangerter et al. . | |
| 4,727,682 | 3/1988 | Stabler et al. | 51/120 |
| 4,759,152 | 7/1988 | Berger et al. | 51/120 |

FOREIGN PATENT DOCUMENTS 2529497 1/1984 France .

OTHER PUBLICATIONS

Patent Abstracts, Japan, vol. 5, No. 22, (M-54)694, 55150964, 11/1980.

Patent Abstracts, Japan, vol. 5, No. 80, (M-70)(752), 5627773, 3/1981.

*Primary Examiner*—Frederick R. Schmidt
*Assistant Examiner*—M. Rachuba
*Attorney, Agent, or Firm*—Michael J. Striker

[57] ABSTRACT

An eccentric grinder having a small construction in the axial direction comprises an eccentric (15), which is driven so as to rotate, and a grinding plate (16) which is rotatably supported in the eccentric (15) and which can be set in rotation around its axis of rotation in one or the other rotating direction via rotating rings (26, 27), which are rigidly connected with the grinding plate (16), and via rolling rings (30, 31), which are arranged at the grinder housing (10), in order to change its grinding action. The selection of the rotating direction is determined by means of a manual switching device (38). For this purpose, the rolling rings (30, 31) are held at the grinder housing (10) so as to be rotatable and are in continuous engagement with the rotating rings (25, 26) fastened at the grinding plate (16). By means of the switching device (38), one of the rolling rings (30, 31), as desired, can be secured against rotation at the grinder housing (10) so that a rolling movement of the grinding plate (16) on the respective secured rolling ring (30, 31) results, or the two rolling rings (30, 31) can be released so as to rotate freely (FIG. 1).

16 Claims, 8 Drawing Sheets

ECCENTRIC GRINDER

PRIOR ART

The invention is based on an eccentric grinder of the generic type defined in the preamble of claim 1.

Such eccentric grinders offer the possibility of driving the grinding plate in three different forms of movement and accordingly of producing different grinding finishes. During the free running of the grinding plate, i.e. without rolling movement of the grinding plate rotating ring on the assigned rolling rings, a fine grinding is achieved, since the movement of every individual abrasive grain per revolution of the eccentric is very small. During the positive driving of the grinding plate opposite the direction of rotation of the eccentric, which is effected by means of the rolling of the external drive means of the second grinding plate rotating ring in the rolling means of the second rolling ring, every abrasive grain on the grinding plate describes a hypocycloid, so that the path of the grinding grains per revolution of the eccentric is increased and a greater grain removal is accordingly forced. The grinding finish changes correspondingly. During the positive driving of the grinding plate in the direction of rotation of the eccentric, which is effected by means of the rolling of the internal drive means of the first grinding plate rotating ring in the rolling means of the first rolling ring, every grinding grain describes a pericycloid. The grinding path of the abrasive grains per revolution of the eccentric is maximal. This grinding movement effects the greatest grain abrasion and is therefore well-suited for coarse grinding.

In a known eccentric grinder of the type named in the beginning (P No. 36 02 571.2) (=EP No. 230 621), the two rolling rings, as double toothed ring with internal and external toothing, are fastened at a sleeve which is stationary in the housing. The two grinding plate rotating rings, which are likewise constructed as toothed rings, are arranged so as to be axially offset relative to one another and are rigidly connected with the grinding plate. In order, respectively, to separate and produce the gearing connection between the rotating rings and their assigned rolling rings, the sleeve in the housing can be axially displaced in three positions. In its lowest position, the first rotating ring meshes with its internal toothing in the external toothing of the double toothed ring; in its upper position, the second rotating ring meshes with its external toothing in the internal toothing of the double toothed ring, while in its middle position the working connections between the double toothed ring and rotating rings are eliminated. This constructional design of the drive switching requires a minimum axial overall height of the grinding housing.

ADVANTAGES OF THE INVENTION

The eccentric grinder, according to the invention, with the characterizing features of claim 1 has the advantage that the desired switching possibility for the grinding movement of the grinding plate is achieved in an extremely small axial overall height of the grinding housing. The switching can be carried out quickly without having to wait for the grinding plate to stop, since the grinding plate rotating rings and their assigned rolling rings need not be engaged first in different planes; rather, they are engaged with one another continuously and from the beginning. The switching can accordingly be carried out without wear on the gearing also during the grinding process, that is, without turning off the drive. The switching device is user-friendly and easy to handle. The continuous engagement of the rotating rings and rolling rings prevents the rolling rings from rotating upward during their free running, since the rolling rings are subjected to a certain friction moment in their guides. The rotating and rolling rings can be constructed either as toothed rings, according to the embodiment form in claim 13, or as friction rings according to the embodiment form in claim 16.

Advantageous developments and improvements of the eccentric grinder indicated in claim 1 are made possible by means of the steps indicated in the additional claims.

An advantageous embodiment form of the invention follows from claim 2. In placing the internal drive means at the outer rim of the grinding plate and the external drive means in the interior of the grinding plate, a difference in the cycloids traveled by the outer abrasive grains in different rotational directions of the grinding plate is achieved which is greater than in the reverse case.

An advantageous embodiment form of the invention also results from claim 4. This constructional design and the use of metal rolling rings achieves a favorable transmission of heat into the interior of the housing, where the heat is then guided away by means of air movement, the heat being generated by means of friction in the drive and rolling means, which engage with one another, and in the ring guides of the rolling rings. The use of corresponding metals, e.g. sintered metals, enables a clean gliding of the rolling rings in the ring guides. In the construction of rotating and rolling rings as toothed rings, a low-noise gearing results with low manufacturing tolerances.

Advantageous variants for the technical construction of the switching device with locking device result from claims 5–12.

An advantageous embodiment form of the invention results, in addition, from claim 14. A softer, more wear-resistant engagement of the rotating and rolling rings, which are constructed as toothed rings, is achieved by means of the sinusoidal toothing. This type of toothing is less sensitive to grinding dust than an involute toothing. The simultaneous engagement of a plurality of teeth is ensured by means of a small difference in the pitch diameters of the rotating and rolling rings.

An advantageous embodiment form of the invention results from claim 15. By means of using these two different materials, ideal toothing ratios and long service life are achieved.

DRAWING

The invention is described in more detail in the following by means of the embodiment examples shown in the drawing.

DESCRIPTION OF THE EMBODIMENT EXAMPLES

Figure 1:
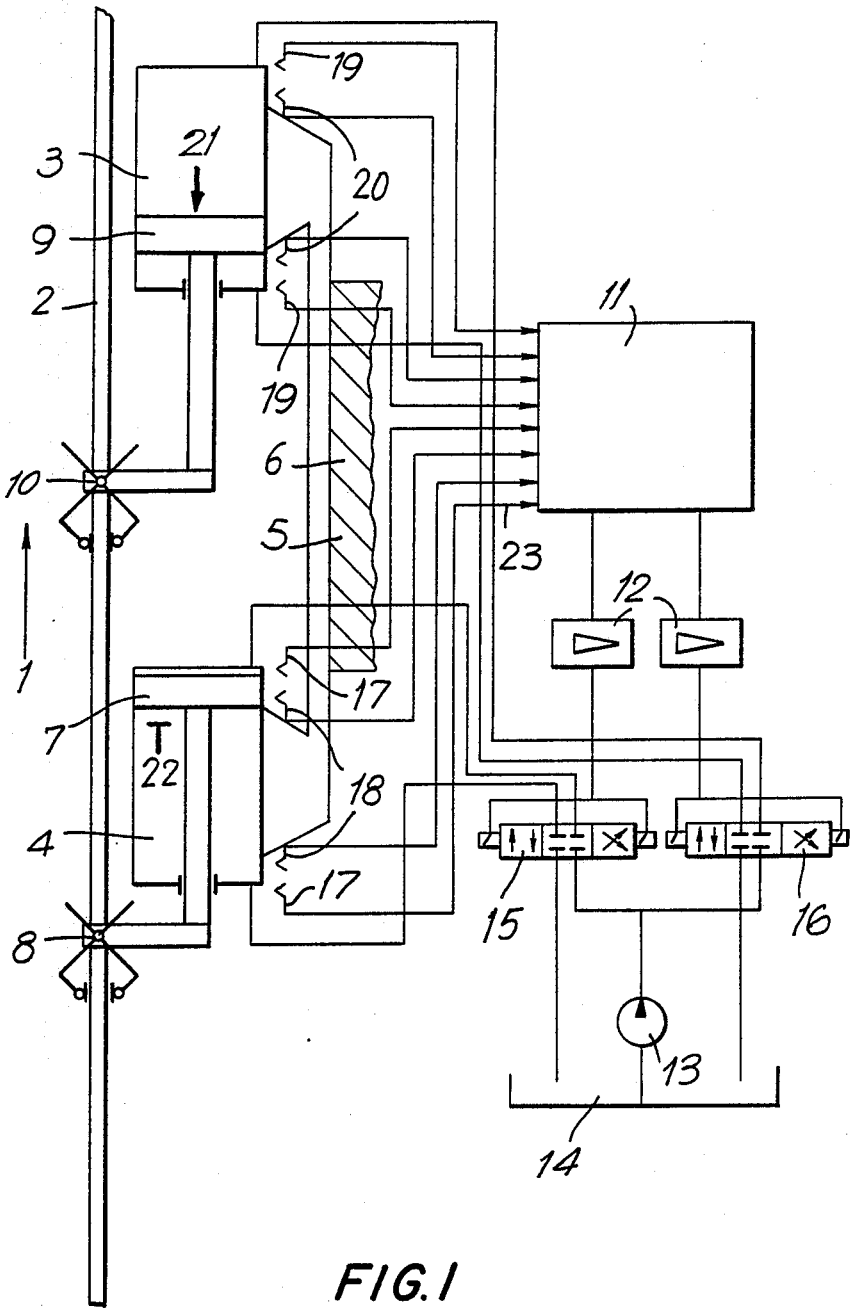
FIG. 1 shows a longitudinal section of an eccentric grinder.
Figure 2:
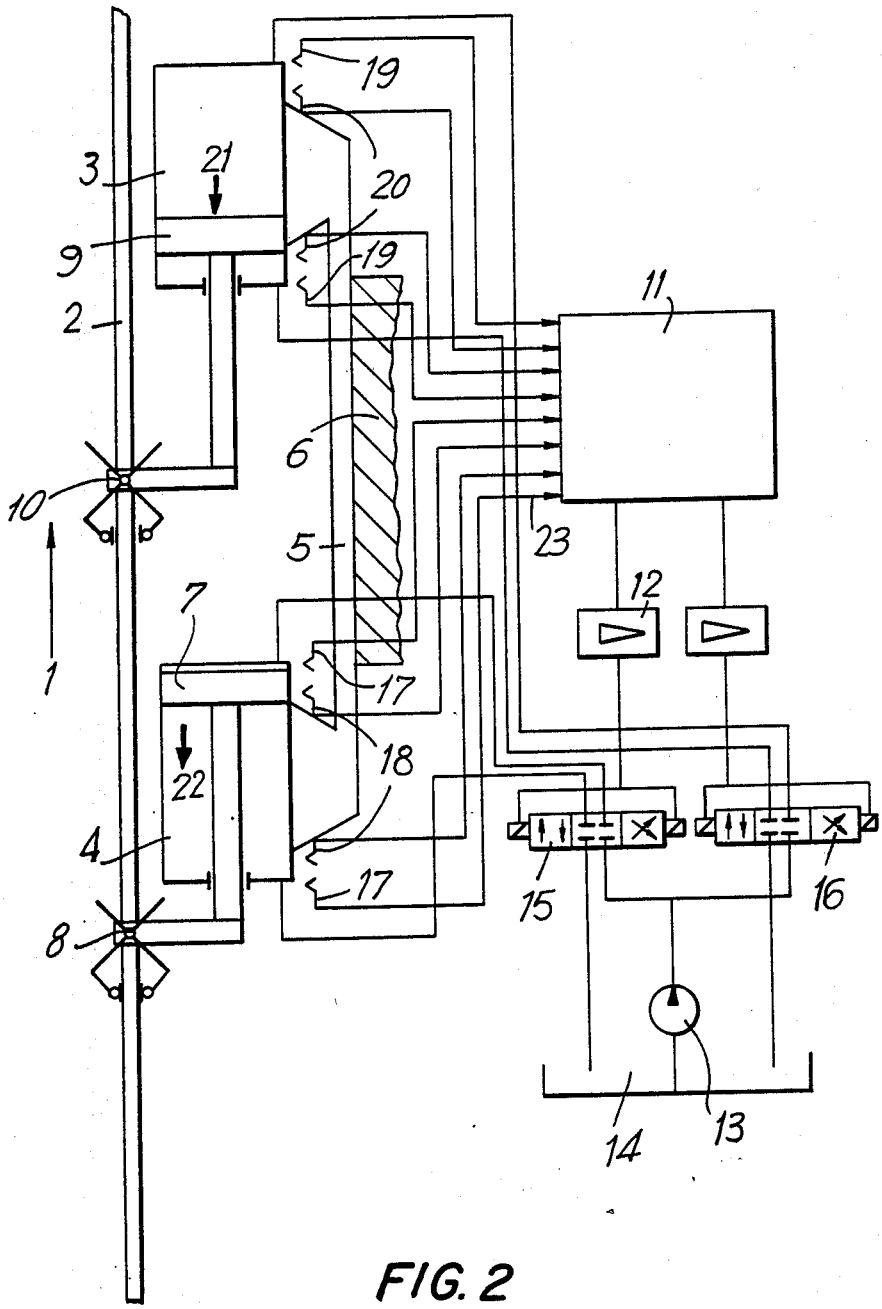
FIG. 2 shows a section along line II—II of the eccentric grinder in FIG. 1 with removed grinding plate.

The eccentric grinder, which can be seen in longitudinal section in FIG. 1, comprises a cup-shaped or bell-shaped housing 10 which is closed at the lower open rim with a metallic supporting plate 11. A suction piece 13, through which air and, accordingly, heat and dust can be sucked out of the housing interior 12, opens into the interior 12 of the housing 10. An eccentric 15 which is driven so as to rotate by means of an electric motor, not shown, via the drive shaft 14 of the latter, is located in the housing interior 12. A grinding plate 16 is supported in the eccentric 15 so as to rotate. For this purpose, a supporting pin 18 is supported in a recess 17 of the eccentric 15 via a ball bearing which penetrates through a through-opening 19 in the supporting plate 11 and carries the grinding plate 16 at the free end face. The grinding plate 16 is fastened on the supporting pin 18 by means of a screw 21 which is screwed into a threaded bore hole 20 in the supporting pin 18. A soft elastic lining 22 is glued on the outer end face of the grinding plate 16, which lining 22 serves to receive the actual grinding disk 23. The axis of rotation 24 of the grinding disk 16 and supporting pin 18 extends parallel to the axis of rotation 25 of the eccentric 15, and accordingly of the drive shaft 14, at a distance corresponding to the degree of eccentricity e.

Figure 8:
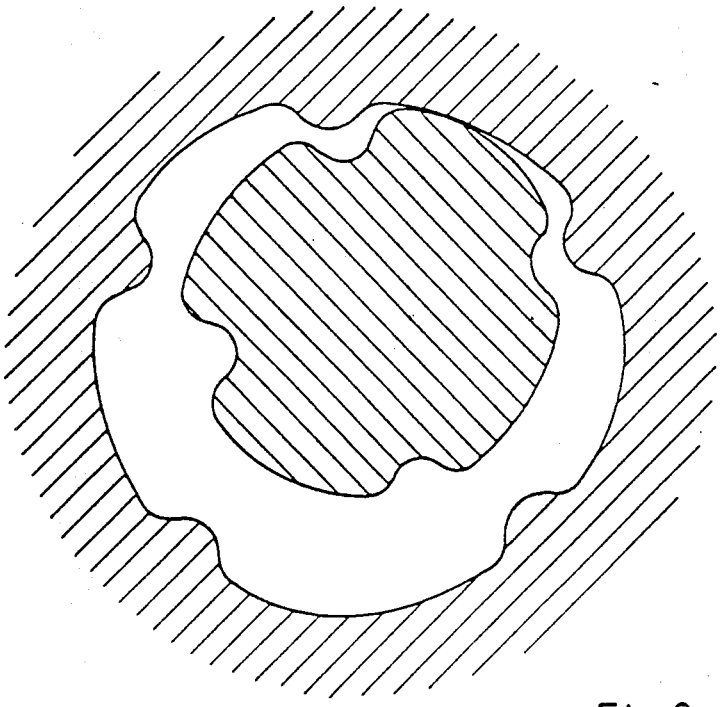
FIG. 8 shows a schematic view of a sinusoidal toothing.
Figure 1:
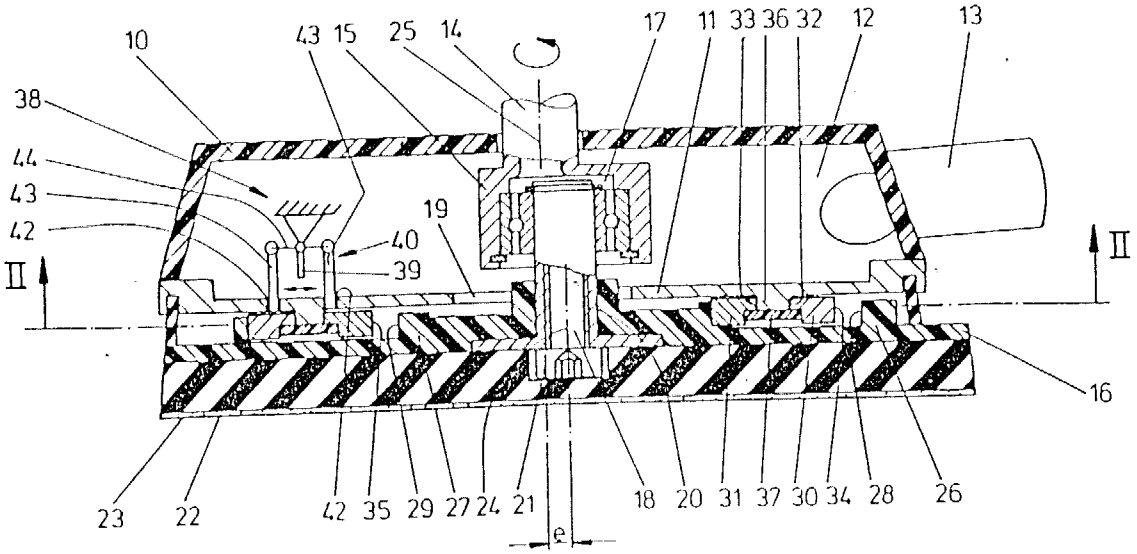
Figure 2:
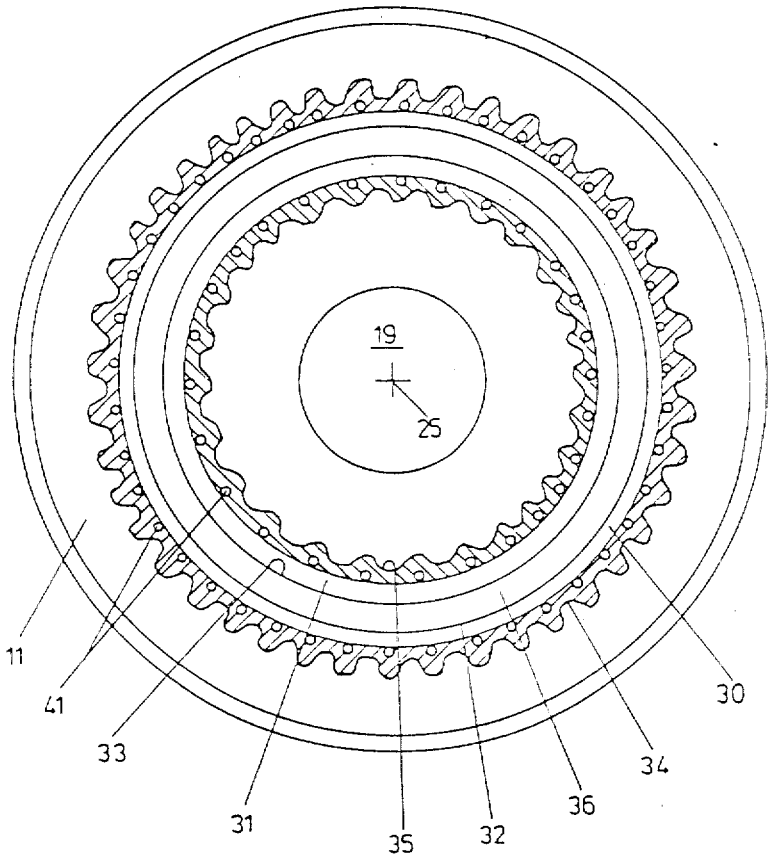
Figure 3:
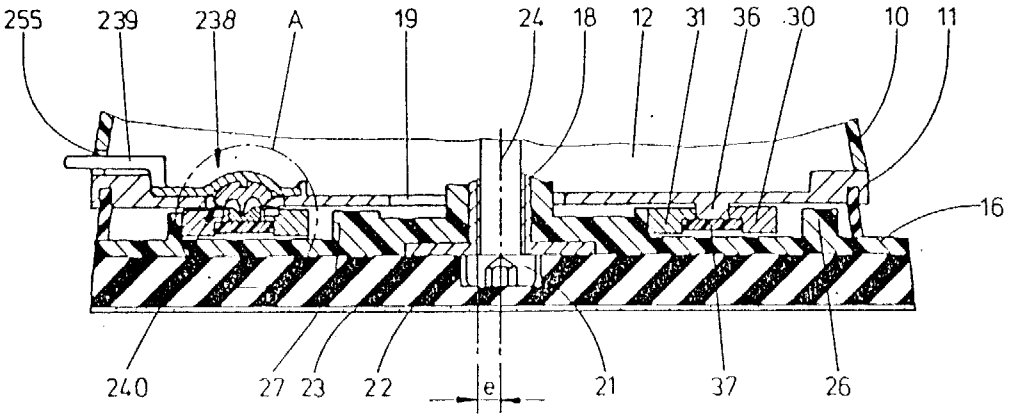
Figure 4:
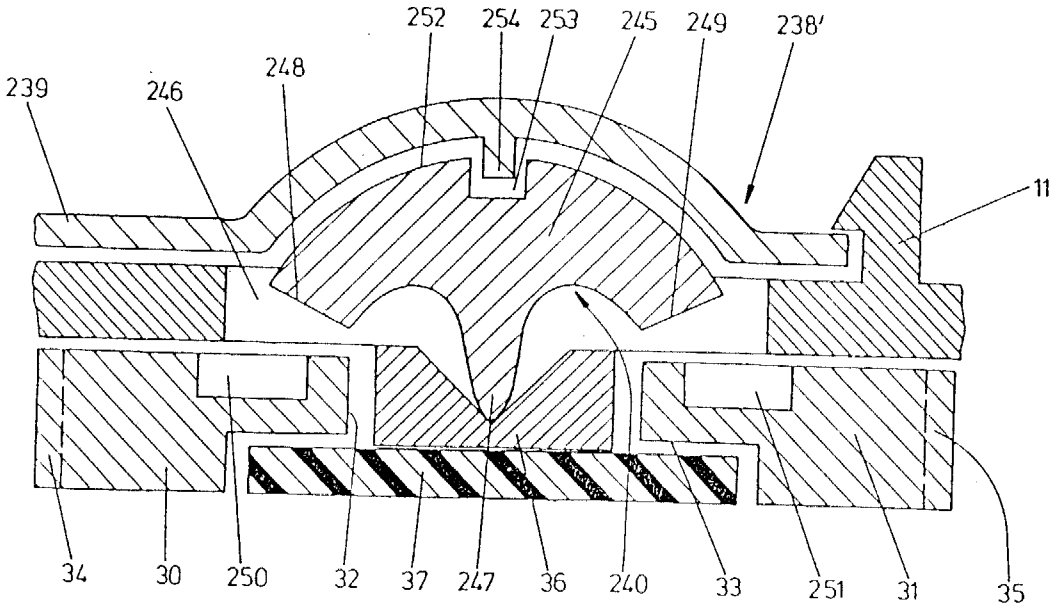

On the back side facing the supporting plate 11, the grinding plate 16 carries two rotating rings 26 and 27 which are fastened so as to be concentric to its axis of rotation 24 and which are preferably constructed so as to form one piece with the grinding plate 16. Every rotating ring 26, 27 is formed by a toothed ring, wherein the first rotating ring 26 having a greater diameter carries an internal toothing 28 and the second rotating ring 27 having a smaller diameter carries an external toothing 29. However, the internal toothing 28 and the external toothing 29 can also be assigned to the other toothed ring, respectively. A rolling ring 30 and 31, respectively, which s likewise constructed as a toothed ring, is assigned to each of the two rotating rings 26, 27. The rolling rings 30, 31 are held in ring guides 32, 33 so as to be rotatable, which ring guides 32, 33 are fastened concentrically at the supporting plate 11. The first rolling ring 30 with the greater diameter carries an external toothing 34 and the second rolling ring 31 with the smaller diameter has an internal toothing 35. The internal toothing 28 of the first rotating ring 26 is in continuous engagement with the external toothing 34 of the first rolling toothed ring 30, and the external toothing 29 of the second rotating ring 27 is in continuous engagement with the internal toothing 35 of the second rolling ring 31. The teeth are constructed as so-called sinusoidal teeth which are shown schematically in FIG. 8. The rolling rings 30, 31 are manufactured out of metal, preferably sintered metal, and the rotating rings 26, 27 are manufactured from plastic. The ring guides 32, 33 are formed by a ring land 36, which projects forward axially at the supporting plate 11 and forms one piece with the latter, and by an annular flange 37 which is fastened on the front side of the ring land 36 and projects forward radially over the ring land 36 on both sides. In this way, two concentric annular grooves are determined as ring guides 37 by the ring land 36, the supporting plate 11 and the annular flange 37; the rolling rings 30, 31 are inserted in these ring guides on their back sides facing away from the teeth 34, 35.

The two rolling rings 30, 31 can either rotate freely in the ring guides 32, 33 or, alternately, can be non-rotatably fastened at the supporting plate 11, so that a total of three different types of movement of the grinding plate 16 are achieved. In addition, a switching device 38 with three switching positions is provided which comprises a switching lever 39, which is swivelable into three switching positions, and a locking device 40 which is actuated by the switching lever 39. The locking device 40 is constructed in such a way that it alternately secures one of the two rolling rings 30, 31 at the supporting plate 11 against rotation in the two extreme positions of the switching lever 39 and, in the middle position of the switching lever located between the two extreme positions, returns to the two rolling rings 30, 31 their free rotational movability in the ring guides 32 and 33. If both rolling rings 30, 31 are freely rotatable in the ring guides 32, 33, the drive of the grinding plate 16 is effected solely via the eccentric 15, wherein the grinding plate 16 is freely rotatable around its axis of rotation 25. The grinding plate therefore executes a movement during grinding which follows a cycloid with superimposed rotational movement, wherein the superposition of the rotational movement is dependent on the contact pressure during grinding. The path of every individual abrasive grain per revolution of the eccentric is very small, which results in a very fine grinding finish. If the first rolling ring 30 with the external toothing 34 is non-rotatably secured at the supporting plate 11, the first rotating ring 26 rolls with its internal toothing 28 on the first rolling ring 30 in its external toothing 34. Every abrasive grain of the grinding disk 23 describes a pericycloid during grinding in this position, in which the rotational movement agrees with the rotational direction of the eccentric 15. Accordingly, the path of the abrasive grains per revolution of the eccentric 15 is at its greatest. This grinding movement effects the greatest removal and is therefore well-suited to coarse grinding. If the inner rolling ring 31 is non-rotatably secured at the supporting plate 11, the second rotating ring 27 rolls with its external toothing 29 in the internal toothing 35 of the second rolling ring 31. Every abrasive grain of the grinding disk 23 now describes a lengthened hypocycloid, wherein it moves opposite the rotational direction of the eccentric 15. This results in a greater removal than during grinding with the free running of the two rolling rings 30, 31, but also in a lesser removal than in the aforementioned grinding movement in which the first rolling ring 30 is secured. The grinding finish is also correspondingly finer in comparison.

The switching device 38 with locking device 40 can be constructed in a different manner. In FIG. 1, the locking device 40 comprises a plurality of recesses in the front sides of the rolling rings 30, 31 facing the supporting plate 11, which recesses are constructed as pocket or through-bore holes 41, and comprises two locking members which are guided, in each instance, in an axial bore hole 42 in the supporting plate 11 and are constructed in this case as round pins 43. The round pins 43 are articulated at a rocker arm 44, specifically on both sides of the fulcrum. The rocker arm 44 is connected with the switching lever 39 in such a way that the rocker arm 44 tilts down on the right-hand or left-hand side out of its middle position, shown in FIG. 1, during the swiveling of the switching lever 39, so that one of the two pins 43 penetrates into a pocket or through-bore hole 41 in one of the rolling rings 30, 31 and accordingly secures the latter at the supporting plate 11 so as to be non-rotatable.

Figure 3:
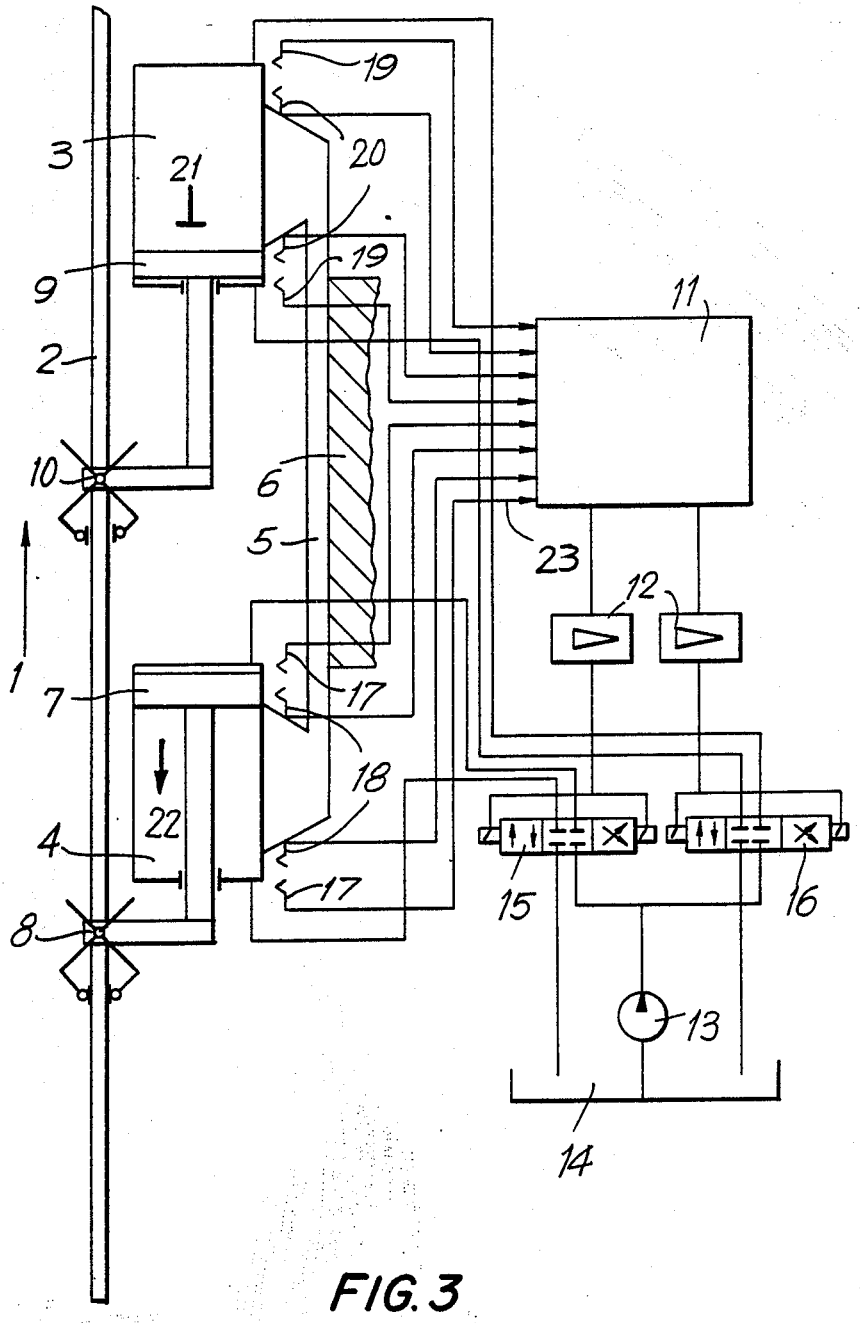
FIG. 3 shows a longitudinal section of an eccentric grinder according to a second embodiment example.
Figure 4:
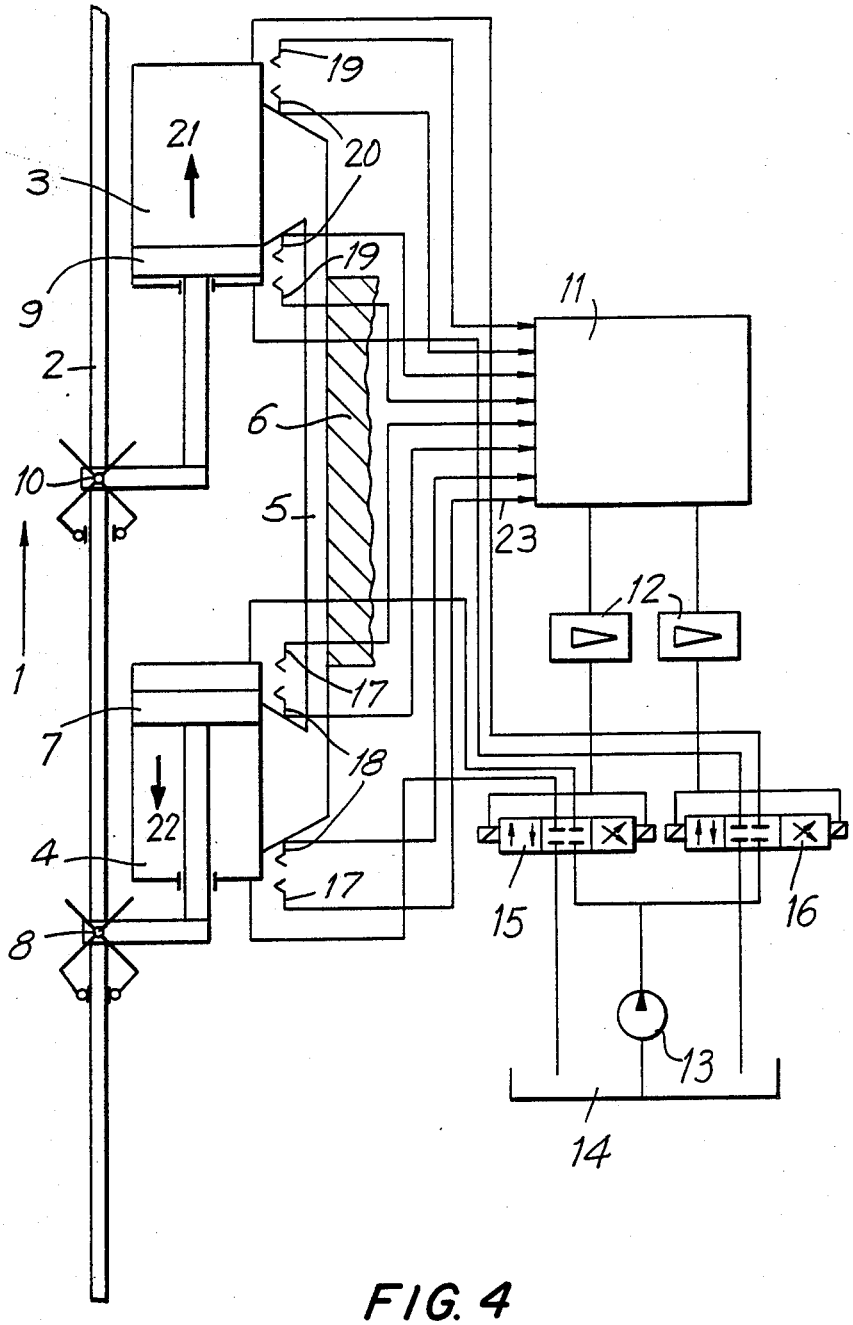
FIG. 4 shows an enlarged view of detail A in FIG. 3.

In the embodiment example of the switching device 238 in FIGS. 3 and 4, the locking device 240 comprises a locking pawl 245 which has the shape of a ring sector in cross section and extends within a circumferentially extending through-opening 246 in the supporting plate 11 along a circumferential portion of the ring land 36 and is supported on the latter by means of a knife-edge bearing 247. The free ends 248 and 249 form locking members which are able to engage in ring segment-shaped recesses 250, 251 in the front sides of the rolling rings 30, 31 facing the supporting plate 11. A guide groove 253 extends in the upper side 252 of the locking pawl 245 in the longitudinal direction of the latter, the upper side 252 facing away from the ring land 36; the switching lever 239 of the switching device 238 overlapping the locking pawl 245 engages in the guide groove 253 with a guide pin 254. The switching lever 239 projects in the radial direction through a slot 255 in the housing 10 and can be swiveled manually in the circumferential direction of the housing. The shape of the guide groove 253 in the locking pawl 245 is determined in such a way as to compel a tilting movement of the locking pawl around its knife-edge bearing 247 toward one side or the other during the displacement of the guide pin 254 as a result of the swiveling of the switching lever 239 into one displacement direction or the other starting e.g. from the center of the longitudinal extent of the guide groove 253 (shown in FIG. 4). Accordingly, one end 248 of the locking pawl 245 penetrates into one of the recesses 250 in the rolling ring 30 in one end swiveling position and the other end 249 of the locking pawl 245 penetrates into one of the recesses 251 of the rolling ring 31 in the other end swiveling position of the switching lever 239 and the respective rolling ring 30 and 31, respectively, is fixed at the supporting plate 11 so as to be non-rotatable.

Figure 5:
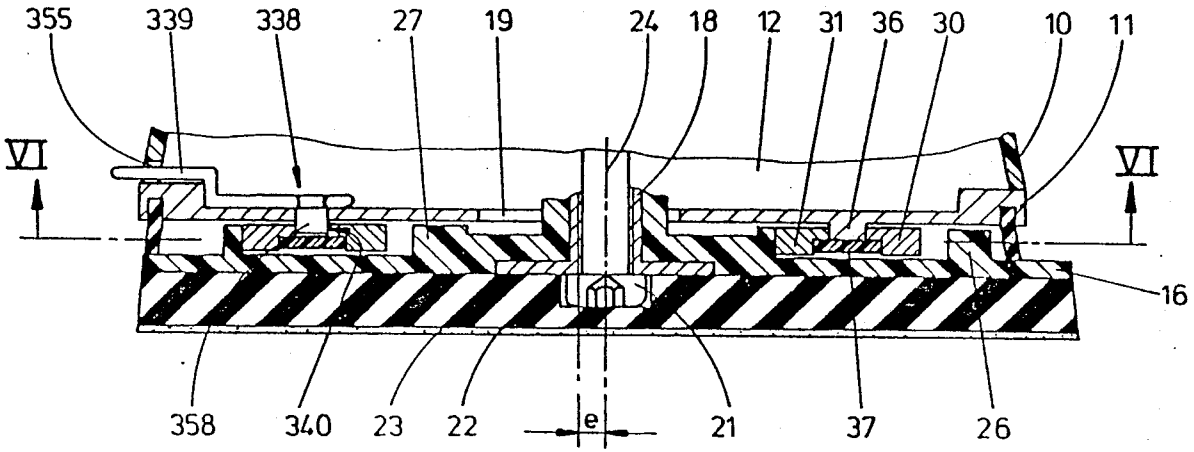
FIG. 5 shows a longitudinal section of an eccentric grinder according to a third embodiment example.
Figure 6:
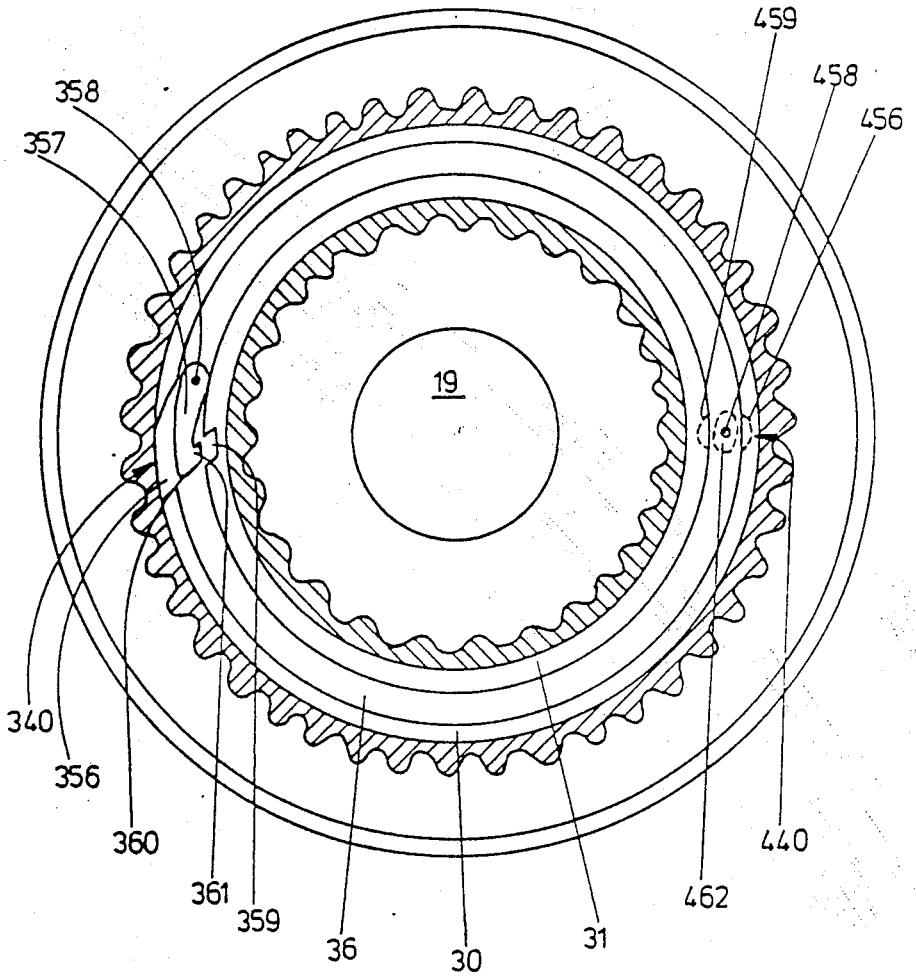
FIG. 6 shows a section along line VI—VI in FIG. 5 without grinding plate.

In the switching device 338 shown schematically in FIGS. 5 and 6, the locking device 340 comprises a positive-locking element, which alternately swivels into the ring guides 32, 33, and at least one positive-locking recess which is provided in every rolling ring 30, 31 and corresponds to the positive-locking element. In the locking device 340 shown in the left half of FIG. 6, the positive-locking element is constructed as a ratchet lever 357 which is swivelably supported at the ring land 36. The ratchet lever 357 is rigidly connected with the switching lever 339 via a pin 358 which is guided through the ring land 36 and the supporting plate 11, which switching lever 339 projects radially through a slot 355 in the housing 10 and can be swiveled manually in the circumferential direction of the housing. The positive-locking recesses are constructed as radial recesses 356 and 359, respectively, in the circumferential surfaces of the rolling rings 30, 31 facing the ring land 36; the ratchet lever 357 can engage in the radial recesses 356 and 359, respectively, with two projections 360, 361 at the end.

In the locking device 440 shown in the right half of FIG. 6, the positive-locking element is constructed as a cam 462 which is connected with the switching lever in the same manner as the ratchet lever 357. The cam 462 can engage in one of the radial recesses 456 and 459, respectively, in the two rolling rings 30, 31 by means of the swiveling of the switching lever and can accordingly lock them with respect to rotation.

If the radial recesses 456, 459 are omitted in the locking device 440, a locking of the rolling rings 30, 31 can be brought about by means of clamping them in the ring guides 32, 33 as a result of the rotation of the cam 462. The cam 462 then constitutes a force-locking element which secures the rolling rings 30, 31 in their ring guides 32, 33 in a force-locking manner.

Figure 7:
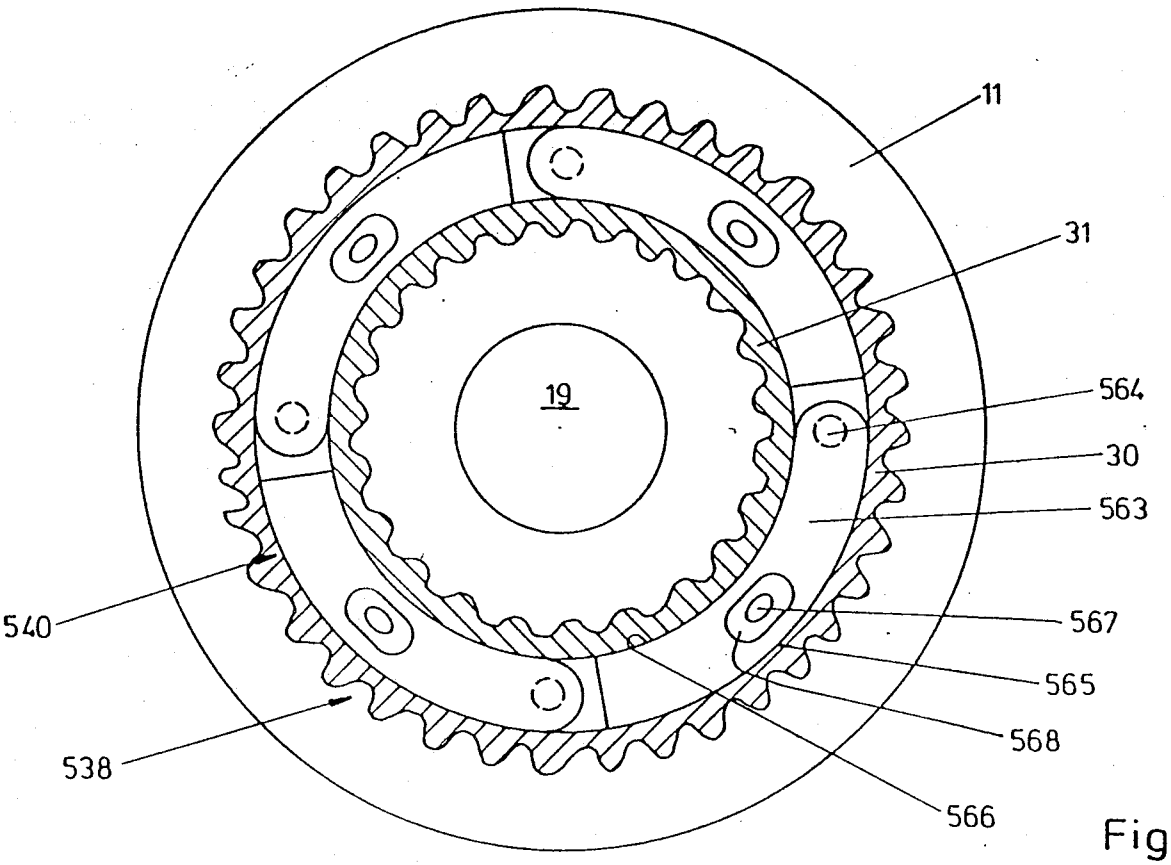
FIG. 7 shows the same view as in FIG. 6 of an eccentric grinder according to another embodiment example.

In the switching device 538 shown in FIG. 7, the locking device 540 likewise comprises a force-locking element which secures the rolling rings 30, 31 in their ring guides 32, 33 in a force-locking manner. In this case, this force-locking element comprises brake shoes 563 which are swivelably supported at the ring land 36 so as to be distributed along its circumference by means of swiveling pins 563. The brake shoes 563 comprise an outer friction face 565 and an inner friction face 566 which can be pressed alternately against the rear sides of the rolling rings 30, 31 facing the web 36. The contact pressure is effected via an eccentric cam 567 which is connected with the switching lever, not shown here, and is rotatable in an oval through-opening 568 in the brake shoes 563. The eccentric cam 567 is swiveled in the left-hand or right-hand direction by means of the swiveling of the switching lever and, in so doing, presses the assigned brake shoes 563 against the outer rolling ring 30 or the inner rolling ring 31. If a plurality of brake shoes 563 are provided, the eccentric cams 567 must be synchronized with one another mechanically. It is also possible to entirely omit the brake shoes and to construct the eccentric cam 567 in such a way that it acts directly on the rear sides of the rolling rings 30, 31 facing the web 36 in a force-locking manner.

The invention is not limited to the embodiment examples described above. The rotating rings and their rolling rings can also be constructed as friction rings instead of toothed rings, which friction rings engage with one another via internal and external friction faces.

We claim:

1. Eccentric grinder comprising a housing, comprising an eccentric which is located therein and driven so as to rotate, comprising a grinding plate which is rotatably supported in the eccentric and whose axis of rotation extends at a distance from and parallel to the axis of rotation of the eccentric, comprising a first grinding plate rotating ring with internal drive means and comprising a second grinding plate rotating ring with external drive means which are both rigidly connected at the grinding plate so as to be concentric to the axis of rotation of the latter and are assigned respectively to one of two rolling rings which are concentric relative to the axis of rotation of the eccentric and comprise external and internal rolling means in the housing, and comprising a switching device which is fastened at the housing and has three manually adjustable switching positions for triggering, as desired, a rolling movement of the first grinding plate rotating ring at the first rolling ring or of the second grinding plate rotating ring at the second rolling ring or for stopping a rolling movement of both grinding plate rotating rings, characterized in that the rolling rings (31, 32) are supported in the housing (10) so as to be rotatable and are in continuous engagement by means of their rolling means (34, 35) with the drive means (28, 29) of the respective assigned grinding plate rotating ring (26, 27), and in that the switching device (38; 238; 338; 438; 538) comprises a locking device (40;

240; 340; 440; 540) which secures the first rolling ring (30) against rotation at the housing (10) in the first switching position and secures the second rolling ring (31) against rotation at the housing (10) in the second switching position and releases both rolling rings (30, 31) for free rotational movement in a third switching position.

2. Grinder according to claim 1, characterized in that the first grinding plate rotating ring (26) with internal drive means (28) has a greater diameter than the second grinding plate rotating ring (27) with external drive means (35), or vice versa.

3. Grinder according to claim 1, characterized in that the rolling rings (30, 31) are held in ring guides (32, 33) which are coaxial relative to the axis of rotation of the eccentric (15).

4. Grinder according to claim 3, characterized in that the ring guides (32, 33) are arranged at a supporting plate 11 which is fastened in the housing (10), aligned transversely relative to the axes of rotation (25, 24) of the eccentric (15) and grinding plate (16) and preferably consists of metal, and are formed by a ring land (36), which projects axially from the supporting plate (11), and an annular flange (37) which is fastened on the front side of the ring land (36) and projects radially over the latter at both sides, and in that the rolling rings (30, 31) lie in one of the annular grooves so as to be rotatable on their rear side facing away from their rolling means (34, 35), which annular grooves are formed by the supporting plate (11), ring land (36) and annular flange (37).

5. Grinder according to claim 4, characterized in that the locking device (340; 440) comprises a positive-locking element (357; 462), which is alternately swivelable into the ring guides (32, 33), and positive-locking recesses (356, 359; 456, 459) which are provided in the rolling rings (30, 31) and correspond to the positive-locking element (357; 462), and in that the positive-locking element (357; 462) is connected with a manually swivelable switching lever (339) by means of which it can be slid out of its middle position, which releases the rolling rings (30, 31), into a positive-locking recess (356, 359; 456, 459) in one or the other rolling ring (30, 31).

6. Grinder according to claim 5, characterized in that the positive-locking element is constructed as a ratchet lever (357), which is swivelably supported at the ring land (36) and rigidly connected with the switching lever (339) projecting radially out of the housing (10) at the end via a pin (358) which passes axially through the ring land (36) and the supporting plate (11), and is able to engage in a radial recess (356, 359) in the circumferential surfaces of the rolling rings (30, 31) facing the ring land (36) in each instance with one of two projections (360, 361).

7. Grinder according to claim 4, characterized in that the locking device (540) comprises a force-locking element (563) which can swivel alternately into the ring guides (32, 33) and is rigidly connected with a manually swivelable switching lever of the switching device (538) and, in each instance, secures one of the rolling rings (30, 31) in the assigned ring guide (32, 33) in a force-locking manner in two swiveling positions of the switching lever located at both sides of a middle position.

8. Grinder according to claim 7, characterized in that the force-locking element is constructed as an eccentric cam (440) which is rigidly connected with the switching lever projecting radially out of the housing (10) at the end via a pin (458), which passes axially through the ring land (36) and the supporting plate (11), and can be brought into a clamping position with one of the two rolling rings (30, 31).

9. Grinder according to claim 7, characterized in that the force-locking element is formed by at least one brake shoe (563) which is held at the ring land (36) so as to be swivelable and can contact, as desired, one of the circumferential surfaces of the two rolling rings (30, 31) facing the ring land (36) in a force-locking manner by means of the switching lever.

10. Grinder according to claim 4, characterized in that the locking device (40; 240) comprises a plurality of recesses (41; 250, 251) in the front sides of the rolling rings (30, 31) facing the supporting plate (11) and at least two locking members (43; 248, 249) which enter through at least one axial through-opening (42; 246) in the supporting plate (11) and which are connected with a manually swivelable switching lever (39; 239) of the switching device (38; 238) in such a way that one of the locking members (43; 248, 249) in each instance engages in a recess (41; 250, 251) in the assigned rolling ring (30, 31) in two extreme lever positions and, in the middle position of the switching lever (39, 239), both locking members (43; 248, 249) are lifted out of the recesses (250, 251).

11. Grinder according to claim 10, characterized in that the locking members are constructed as round pins (43) which are guided in an axial bore hole (42) of the supporting plate (11) and are articulated on both sides of the fulcrum at a two-legged rocker arm (44) which is coupled with the switching lever (39), and in that the recesses are constructed as axial pocket or through-bore holes (41).

12. Grinder according to claim 10, characterized in that the locking members are formed by the free ends (148, 249) of a locking pawl (245) which has the shape of a ring sector in cross section and extends within the through-opening (246) along a circumferential portion of the ring land (36) so as to be parallel to the latter and is supported on it by means of a knife-edge bearing (247), in that a guide groove (253) extends in the upper side (252) of the locking pawl (245) in the longitudinal direction of the latter, which upper side (252) faces away from the ring land (36), a guide pin (254) arranged at the switching lever (239) of the switching device (238) being guided into the guide groove (253) so as to be displaceable, the switching lever (239) being swivelable in the circumferential direction of the housing (10), and in that the configuration of the guide groove (253) in the locking pawl (245) is determined in such a way that a tilting movement of the locking pawl (245) around its knife-edge bearing (247) toward one or the other side is compelled during the displacement of the guide pin (254) into one or the other displacement direction starting e.g. from the center of the longitudinal extension of the guide groove (253).

13. Grinder according to claim 1, characterized in that the grinding plate rotating rings rolling rings (30, 31) are constructed as toothed rings, and the drive or rolling means are formed by the teeth (28, 29, 34, 35) engaging with one another on the inner and outer side of the toothed rings, respectively.

14. Grinder according to claim 13, characterized in that the teeth (28, 34 and 29, 35, respectively), which engage with one another, are constructed as sinusoidal teeth.

15. Grinder according to claim 13, characterized in that the toothed rings forming the rolling rings (30, 31)

are produced from metal and the toothed rings forming the grinding plate rotating rings (26, 27) are produced from plastic.

16. Grinder according to claim 1, characterized in that the grinding plate rotating rings (26, 27) and the rolling rings (3, 31) are constructed as friction faces, and the drive or rolling means are formed by friction faces which engage with one another on the inner and outer sides, respectively, of the friction rings.

* * * * *

UNITED STATES PATENT AND TRADEMARK OFFICE

CERTIFICATE OF CORRECTION

PATENT NO. : 4,918,868

DATED : Apr. 24, 1990

INVENTOR(S) : Walter Barth, et al.

It is certified that error appears in the above-identified patent and that said Letters Patent is hereby corrected as shown below:

The title page, showing the illustrative figure, should be deleted to appear as per attached title page.

Figures 1-4 of the drawings should be deleted to as per attached Drawing Sheets, consisting of FIGS. 1-4.

Signed and Sealed this

Fourteenth Day of July, 1992

*Attest:*

DOUGLAS B. COMER

*Attesting Officer*

*Acting Commissioner of Patents and Trademarks*

United States Patent [19]

Barth et al.

[11] Patent Number: 4,918,868

[45] Date of Patent: Apr. 24, 1990

[54] ECCENTRIC GRINDER

[75] Inventors: Walter Barth, Leinfelden; Karl-Heinz Braunbach, Hornbach; Manfred Stäbler, Leinfelden-Echterdingen, all of Fed. Rep. of Germany

[73] Assignee: Robert Bosch GmbH, Stuttgart, Fed. Rep. of Germany

[21] Appl. No.: 368,363

[22] PCT Filed: Nov. 21, 1987

[86] PCT No.: PCT/DE87/00540

§ 371 Date: Jun. 6, 1989

§ 102(e) Date: Jun. 6, 1989

[87] PCT Pub. No.: WO88/04218

PCT Pub. Date: Jun. 16, 1988

[30] Foreign Application Priority Data

Dec. 13, 1986 [DE] Fed. Rep. of Germany ..... 3642741

[51] Int. Cl.[5] ..... B24B 7/00

[52] U.S. Cl. ..... 51/120; 51/170 MT

[58] Field of Search ..... 51/120, 170 MT, 119, 51/90, 170 TL; 74/804, 805

[56] References Cited

U.S. PATENT DOCUMENTS

| | | | |
|---|---|---|---|
| 2,794,303 | 6/1957 | Wickes . | |
| 3,482,362 | 12/1969 | Bangerter et al. . | |
| 4,727,682 | 3/1988 | Stabler et al. | 51/120 |
| 4,759,152 | 7/1988 | Berger et al. | 51/120 |

FOREIGN PATENT DOCUMENTS 2529497 1/1984 France .

OTHER PUBLICATIONS

Patent Abstracts, Japan, vol. 5, No. 22, (M-54)694, 55150964, 11/1980.

Patent Abstracts, Japan, vol. 5, No. 80, (M-70)(752), 5627773, 3/1981.

*Primary Examiner*—Frederick R. Schmidt
*Assistant Examiner*—M. Rachuba
*Attorney, Agent, or Firm*—Michael J. Striker

[57] ABSTRACT

An eccentric grinder having a small construction in the axial direction comprises an eccentric (15), which is driven so as to rotate, and a grinding plate (16) which is rotatably supported in the eccentric (15) and which can be set in rotation around its axis of rotation in one or the other rotating direction via rotating rings (26, 27), which are rigidly connected with the grinding plate (16), and via rolling rings (30, 31), which are arranged at the grinder housing (10), in order to change its grinding action. The selection of the rotating direction is determined by means of a manual switching device (38). For this purpose, the rolling rings (30, 31) are held at the grinder housing (10) so as to be rotatable and are in continuous engagement with the rotating rings (25, 26) fastened at the grinding plate (16). By means of the switching device (38), one of the rolling rings (30, 31), as desired, can be secured against rotation at the grinder housing (10) so that a rolling movement of the grinding plate (16) on the respective secured rolling ring (30, 31) results, or the two rolling rings (30, 31) can be released so as to rotate freely (FIG. 1).

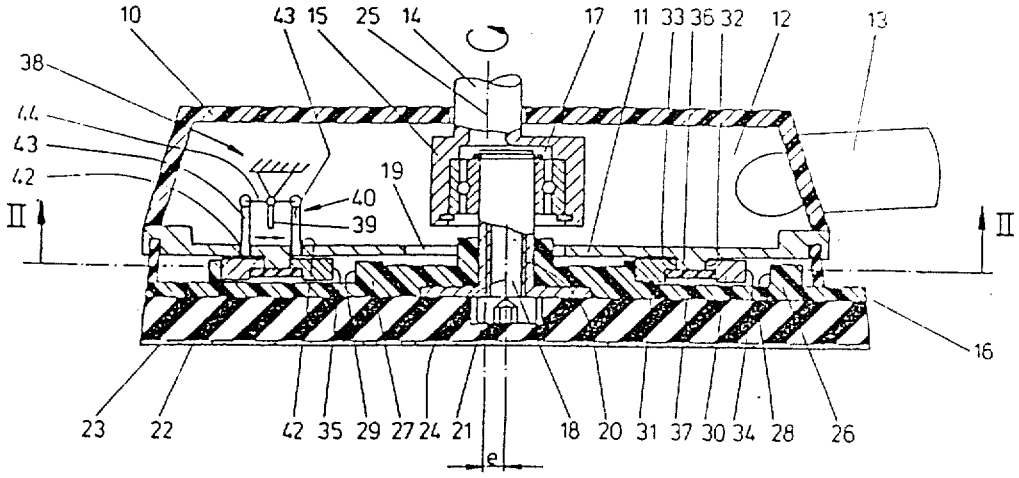

16 Claims, 8 Drawing Sheets